US008911050B2

(12) United States Patent
Nishihara

(10) Patent No.: US 8,911,050 B2
(45) Date of Patent: Dec. 16, 2014

(54) DROPLET EJECTING APPARATUS AND COMPUTER-READABLE MEDIUM

(71) Applicant: Masahiro Nishihara, Nagoya (JP)

(72) Inventor: Masahiro Nishihara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/851,600

(22) Filed: Mar. 27, 2013

(65) Prior Publication Data

US 2014/0092162 A1 Apr. 3, 2014

(30) Foreign Application Priority Data

Sep. 28, 2012 (JP) ..... 2012-218403

(51) Int. Cl.
*B41J 29/38* (2006.01)

(52) U.S. Cl.
USPC ..... 347/14; 347/19; 347/102

(58) Field of Classification Search
USPC ..... 347/5, 9, 14, 15, 19, 102
See application file for complete search history.

(56) References Cited

U.S. PATENT DOCUMENTS

| | | | | |
|---|---|---|---|---|
| 7,771,036 | B2 | 8/2010 | Ono | |
| 2008/0012894 | A1 | 1/2008 | Ono | |
| 2011/0234672 | A1 * | 9/2011 | Ohtsu et al. | 347/14 |

FOREIGN PATENT DOCUMENTS

| | | | |
|---|---|---|---|
| JP | 2004-188656 | A | 7/2004 |
| JP | 2007-152787 | A | 6/2007 |
| JP | 2008-018664 | A | 1/2008 |

* cited by examiner

*Primary Examiner* — Lam S Nguyen
(74) *Attorney, Agent, or Firm* — Banner & Witcoff, Ltd.

(57) ABSTRACT

In recording on a back side of a sheet in duplex recording, an overlapping pixel where both a pixel in back-side image data and a pixel opposed thereto in front-side image data has a gray level value larger than zero is retrieved from the front-side and back-side image data. A block area containing at least a predetermined number of overlapping pixels is extracted as an overlap area from block areas arranged in a matrix in the back-side image data. The area drying time in a block area other than the overlap area is determined from the volume of droplets to be ejected to the back side. The area drying time in the overlap area is determined from the total volume of droplets to be ejected to the front and back sides. The maximum area drying time is determined to be the drying time for the back side.

18 Claims, 12 Drawing Sheets

DROPLET EJECTING APPARATUS AND COMPUTER-READABLE MEDIUM

CROSS REFERENCE TO RELATED APPLICATION

This application claims priority from Japanese Patent Application No. 2012-218403, filed on Sep. 28, 2012, the disclosure of which are incorporated herein by reference in their entirely.

BACKGROUND

1. Field

Aspects of the present invention relate to a droplet ejecting apparatus and computer-readable medium for the droplet ejecting apparatus.

2. Description of the Related Art

An inkjet printer may calculate a drying time to dry ink ejected on a sheet and cause printing to wait for that time to prevent an adjacent sheet when printed sheets are stacked in sequence from becoming dirty with the ink. If the waiting time is long, printing throughput decreases. Accordingly, it is necessary to calculate a minimum drying time. To address this issue, a technique of determining a drying time from the total amount of ink ejected on both sides of a sheet in duplex printing and adjusting a printing speed is known.

SUMMARY

Even when the same total amount of ink is ejected, the ink, when ink-ejected areas overlap each other on both sides of a recording medium, tends to take longer to dry than when the ink-ejected areas do not overlap each other on both sides of the recording medium. Consequently, with the above-described technique, a drying time shorter than necessary may be calculated, and a sheet which is not sufficiently dry may be discharged.

Aspects of a droplet ejecting apparatus and computer-readable medium for the droplet ejecting apparatus disclosed herein may determine a setting for a process of drying a recording medium in duplex recording.

BRIEF DESCRIPTION OF THE DRAWINGS

For a more complete understanding of the disclosure, reference now is made to the following description taken in connection with the accompanying drawings.

DETAILED DESCRIPTION

A preferred illustrative embodiment of the present invention is described below with reference to the drawings.

Figure 1:
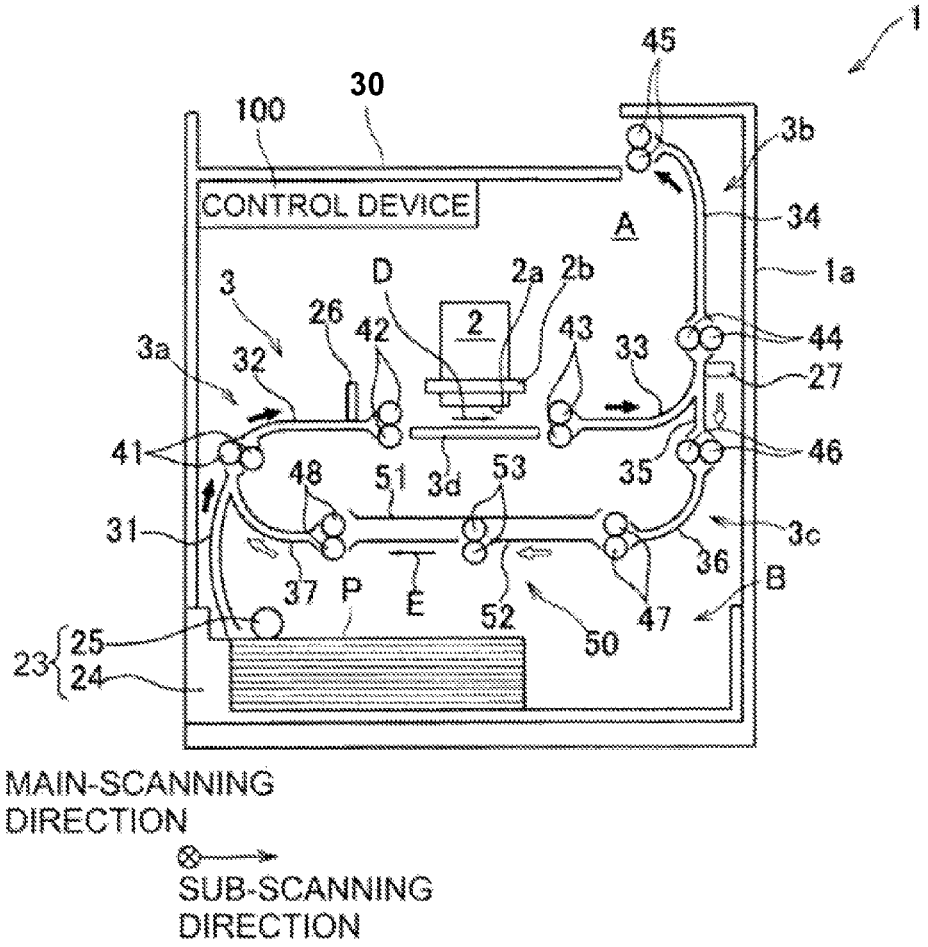
FIG. 1 is a side view that shows a schematic illustration of an internal structure of an inkjet printer as a recording apparatus that includes a conveying device according to an illustrative embodiment of the present invention.

First, a general configuration of an inkjet printer 1 as a recording apparatus that includes a conveying device according to an illustrative embodiment of the present invention is described with reference to FIG. 1.

The printer 1 includes a casing 1*a* having a rectangular parallelepiped shape. The upper part of the top of the casing 1*a* defines a discharge tray 30. The space inside the casing 1*a* can be divided into spaces A and B in order from above. A paper conveying path extending from a paper feed device 23 to the discharge tray 30 and a paper reconveying path extending from the downstream side toward the upstream side of the paper conveying path are present in the spaces A and B. As illustrated in FIG. 1, a sheet P is conveyed along the route indicated by the thick solid arrows in the paper conveying path, and is conveyed along the route indicated by the thick hollow arrows in the paper reconveying path. In the space A, the sheet P is subjected to image recording, is conveyed to the discharge tray 30, and is reconveyed. In the space B, a sheet is fed from the paper feed device 23 to the paper conveying path.

A head 2 for ejecting black ink, a conveying device 3, a control device 100, and other components are disposed in the space A. Although not illustrated, a cartridge is loaded in the space A. The cartridge stores black ink. The cartridge is connected to the head 2 with a tube and a pump (both are not illustrated) disposed therebetween, and the ink is supplied to the head 2.

The head 2 is a line head having a substantially rectangular parallelepiped shape with a longer length in the main-scanning direction. The lower surface of the head 2 is an ejection surface 2*a* having multiple ejection orifices. In recording, black ink is ejected through the ejection surface 2*a*. The head 2 is supported on the casing 1*a* with a head holder 2*b* disposed therebetween. The head holder 2*b* holds the head 2 such that a predetermined gap suited for recording is formed between the ejection surface 2*a* and a platen 3*d* (described below).

The conveying device 3 includes an upstream guide device 3*a*, a downstream guide device 3*b*, a reconveying guide device 3*c*, and the platen 3*d*. The platen 3*d* faces the ejection surface 2*a* of the head 2. The platen 3*d* has a flat upper surface, supports the sheet P from below, and defines a recording zone (part of the paper conveying path) between the ejection surface 2*a* and platen 3*d*. The platen 3*d* is disposed between the upstream guide device 3*a* and the downstream guide device 3*b*. The upstream guide device 3*a* includes two guides 31 and 32 and two pairs of conveying rollers 41 and 42. The upstream guide device 3*a* links the recording zone (between the platen 3*d* and head 2) and the paper feed device 23. The downstream guide device 3*b* includes two guides 33 and 34 and three pairs of conveying rollers 43 to 45. The downstream guide device 3*b* links the recording zone and the discharge tray 30. The paper conveying path is defined by the four guides 31 to 34, platen 3*d*, and head 2.

The reconveying guide device 3*c* includes three guides 35 to 37, three pairs of conveying rollers 46 to 48, and a positioning mechanism 50. The reconveying guide device 3*c* bypasses the recording zone and links the upstream guide device 3*a* and downstream guide device 3*b*. The guide 35 is connected to the guide 33 at a site before its end, and links the reconveying guide device 3*c* and downstream guide device 3*b*. The guide 37 is connected to the guide 31 at a site before its end, and links the reconveying guide device 3*c* and upstream guide device 3*a*. The paper reconveying path is defined by the three guides 35 to 37 and positioning mechanism 50.

The pair of conveying rollers 44 can switch the direction of conveying the sheet P under the control of the control device 100. That is, in conveying of the sheet P from the recording zone to the discharge tray 30, the pair of conveying rollers 44 rotates such that the sheet P is conveyed upward. In contrast, in conveying of the sheet P from the paper conveying path to the paper reconveying path, the rotation direction of the pair of conveying rollers 44 is switched such that, when the rear end of the sheet P is present between the connection of the guides 33 and 35 and the pair of conveying rollers 44 is detected by a sheet sensor 27, the sheet P is conveyed downward such that the rear end is turned to the leading end. The sheet P having been conveyed from the paper conveying path to the paper reconveying path is reconveyed to the upstream guide device 3*a*. At this time, the sheet P being reconveyed is conveyed to the recording zone again in the state where the front and back sides of the sheet P are opposite to those during the previous passage through the recording zone. In this way, images can be recorded on both sides of the sheet P.

The three pairs of conveying rollers 46 to 48 are arranged in this order. The positioning mechanism 50 is disposed between the pairs of conveying rollers 47 and 48. The positioning mechanism 50 includes an upper guide 51, a lower guide 52, and a pair of oblique conveying rollers 53. The positioning mechanism 50 positions the sheet P in the width direction.

The conveying device 3 is controlled by the control device 100 such that the sheet P is discharged to the discharge tray 30 by the guide 34 and pair of conveying rollers 45 after the black ink ejected to the sheet P is dried. If the sheet P in the state where the sheet P with the black ink ejected by the head 2 has not been dried is discharged to the discharge tray 30, because the surface of the sheet P to which the black ink has been ejected faces down in FIG. 1 (face-down discharge), the undried black ink on the sheet P is typically attached to the discharge tray 30 or a surface of another sheet P previously placed on the discharge tray 30 (setoff), and the discharge tray 30 or the surface of the sheet P on the discharge tray 30 typically becomes dirty. In recording images on both sides of the sheet P, if the sheet P with undried black ink is conveyed along the above-described paper reconveying path, the undried black ink may be attached to the paper reconveying path, and the paper reconveying path may become dirty. In this case, making the sheet P wait at the guide 34 in the conveying device 3 to naturally dry the sheet P with the ejected black ink before the sheet P is conveyed along the paper reconveying path can prevent the paper reconveying path and other devices from becoming dirty. Examples of a method of drying the sheet P at the guide 34 can include drying the sheet P at the guide 34 in the state where the rear end of the sheet P is sandwiched between the pair of conveying rollers 44 and drying the sheet P at the guide 34 in the state where the front end of the sheet P is sandwiched between the pair of conveying rollers 45. When the discharge tray 30 or the surface of another sheet P on the discharge tray 30 does not become dirty, the sheet P may be dried in the state where the sheet P is sandwiched between the pair of conveying rollers 45 and where part of the sheet P protrudes above the discharge tray 30. Alternatively, the sheet P can be discharged to the discharge tray 30 after the conveying device 3 conveys the sheet P at low speeds using the guide 34 and pair of conveying rollers 45 under the control of the control device 100 until the sheet P with ejected black ink has been dried.

The paper feed device 23 is disposed in the space B. The paper feed device 23 includes a paper feed tray 24 and a paper feed roller 25. The paper feed tray 24 is attachable to and detachable from the casing la. The paper feed tray 24 has an upwardly opened box shape and can accommodate a plurality of sheets P. The paper feed roller 25 feeds the uppermost sheet P in the paper feed tray 24.

The sub-scanning direction used here is a direction parallel with the direction D of conveying sheets by the pairs of conveying rollers 42 and 43 and with the direction E of conveying sheets by the pairs of conveying rollers 47 and 48 and the pair of oblique conveying rollers 53. The main-scanning direction used here is a direction that is in the same plane as that of the sub-scanning direction and that is perpendicular to the sub-scanning direction.

Figure 2:
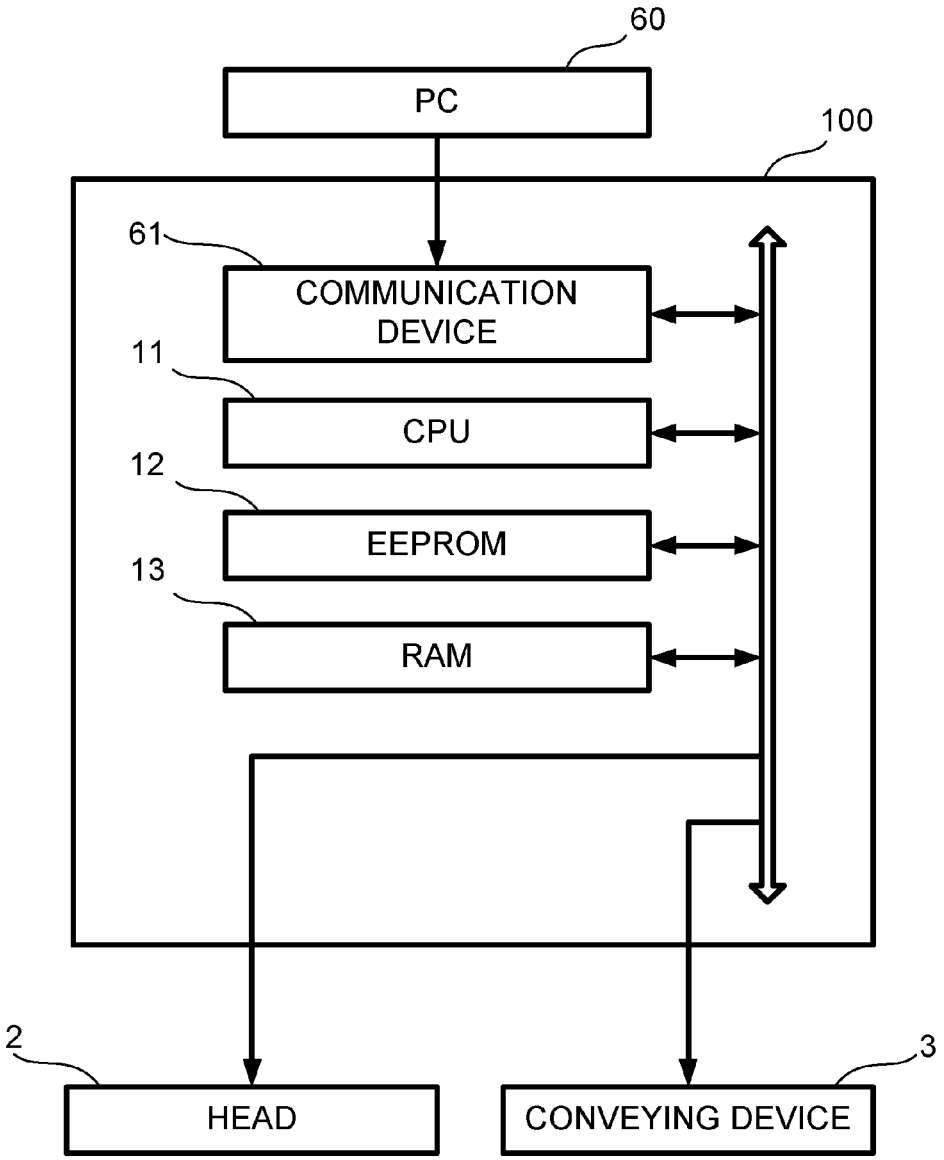
FIG. 2 illustrates a physical configuration of the inside of a control device illustrated in FIG. 1 according to an illustrative aspect.

The control device 100 is described next. As illustrated in FIG. 2, the control device 100 includes a central processing unit (CPU) 11, an electrically erasable and programmable read only memory (EEPROM) 12, a random access memory (RAM) 13, and a communication device 61. The EEPROM 12 stores a program executable by the CPU and data for use in the program such that they are allowed to be rewritten. The RAM 13 temporarily stores data during the execution of the program. The communication device 61 is an interface that exchanges data with an external apparatus, such as a personal computer (PC) 60, in a wireless or wired manner. The functional units (see FIG. 3) forming the control device 100 may be software stored in the EEPROM 12. The program can be stored in various kinds of storage media, including a flexible disk, a compact-disk ROM (CD-ROM), and a memory card, and is installed from the storage medium into the EEPROM. The control program recorded on the storage medium may be directly executable by the CPU 11 or be allowed to be executed only after it is installed in the EEPROM 12. Alternatively, the program may be encoded or compressed.

Figure 3:
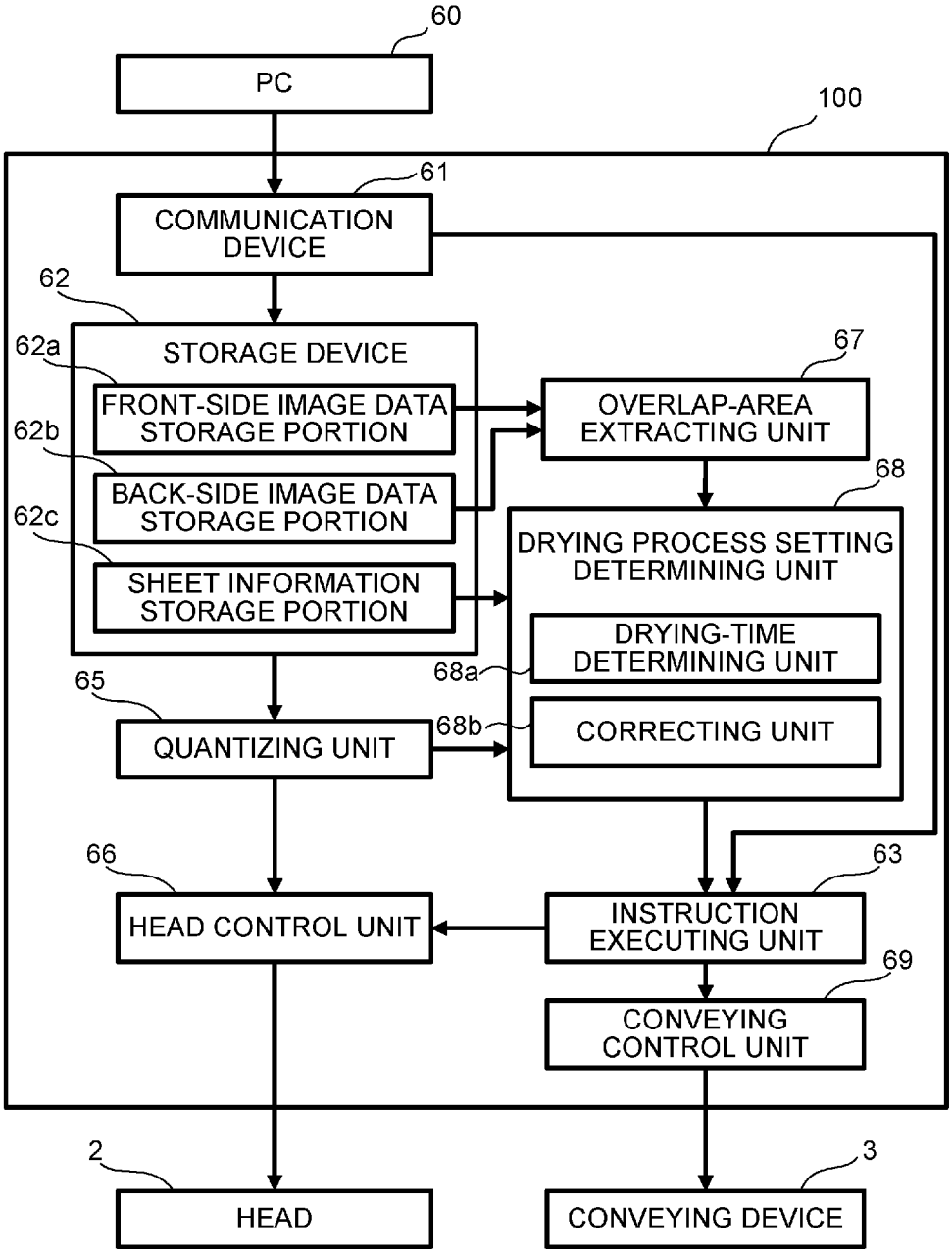
FIG. 3 is a functional block diagram of the control device illustrated in FIG. 1 according to an illustrative aspect.

The control device 100 controls the operations of each device of the printer 1 and performs the operation of the printer 1 as a whole. The control device 100 controls a recording operation on the basis of a recording instruction supplied from an external apparatus (for example, the PC 60 connected to the printer 1 in FIG. 2). Specifically, the control device 100 controls an operation of conveying the sheet P, an operation of ejecting ink in synchronization with conveying of the sheet P, and other operations. The details are specifically described below. As illustrated in FIG. 3, the control device 100 includes, as the functional units, the communication device 61, a storage device 62, a quantizing unit 65, an overlap-area extracting unit 67, a drying process setting determining unit 68, a head control unit 66, a convey control unit 69, and an instruction executing unit 63. The PC 60 sends the recording instruction to the printer 1. The recording instruction contains an instruction indicating an operation to be executed and a data set necessary for the operation, for example, image data to be recorded (described below) and sheet information on the sheet P being a recording target.

Figure 4A:
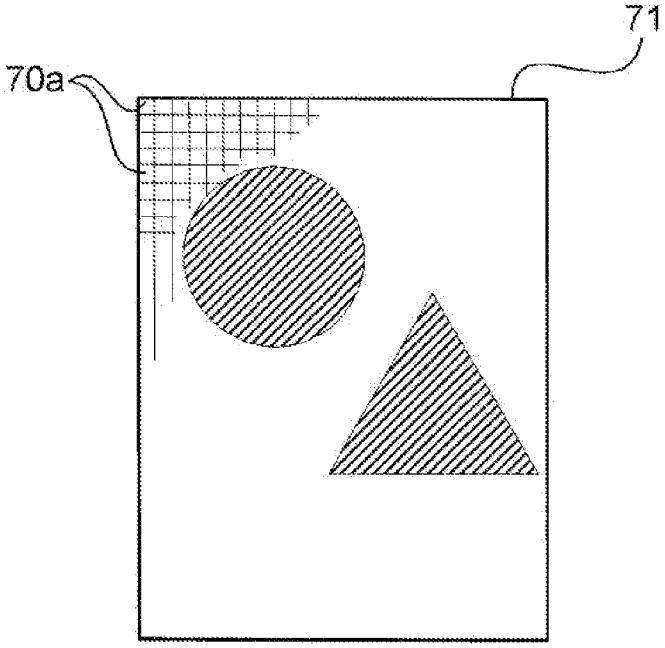
FIG. 4A is an illustration for describing image data stored in a front-side image data storage portion illustrated in FIG. 3.
Figure 4B:
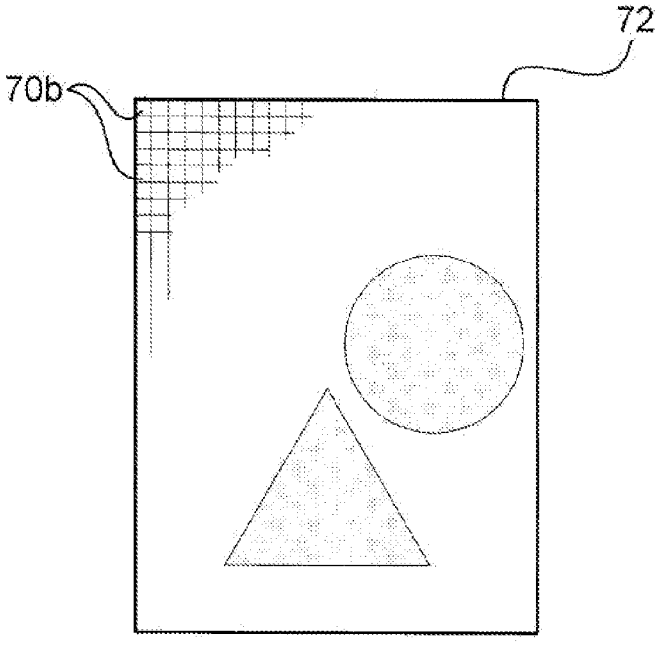
FIG. 4B is an illustration for describing image data stored in a back-side image data storage portion illustrated in FIG. 3 according to illustrative aspects.

The storage device 62 includes a front-side image data storage portion 62*a*, a back-side image data storage portion 62*b*, and a sheet information storage portion 62*c*. Each of the front-side image data storage portion 62*a* and back-side image data storage portion 62*b* stores image data contained in the recording instruction sent from the PC 60. As illustrated in FIGS. 4A and 4B, the image data includes a plurality of pixels arranged in a matrix, the pixels having their respective gray level values (for example, values of 256 gray levels represented by 0 to 255 in the present illustrative embodiment). The image data can be classified into front-side image data 71 containing gray level values of pixels 70*a* relating to an image to be recorded on the front side of the sheet P and back-side image data 72 containing gray level values of pixels 70*b* relating to an image to be recorded on the back side of the sheet P in duplex recording. The front-side image data 71 is stored in the front-side image data storage portion 62*a*. The back-side image data 72 is stored in the back-side image data storage portion 62*b*.

The sheet information storage portion 62*c* stores sheet information on the sheet P being a recording target sent from the PC 60. The sheet information contains a sheet size, sheet orientation, and ink penetration rate corresponding to the type (material and thickness) of the sheet.

The quantizing unit 65 reduces a gray level value of 256 gray levels of each of the pixels 70*a* and 70*b* contained in the front-side image data 71 and back-side image data 72 to a gray level value corresponding to the category of the volume of ink droplets to be ejected from the head 2 (four categories of zero, small droplet, medium droplet, and large droplet in the present embodiment). In this way, droplet data for use in driving the head 2 is created from the image data. At this time, the quantizing unit 65 diffuses an error occurring in the reduction in the gray level value to other pixels 70*a* and 70*b* around the pixels 70*a* and 70*b* being the target of quantization. That is, the quantizing unit 65 performs an error diffusion process, which is a typical quantization process. The errors resulting from quantization may be adjusted using other quantization algorithms.

Figure 5:
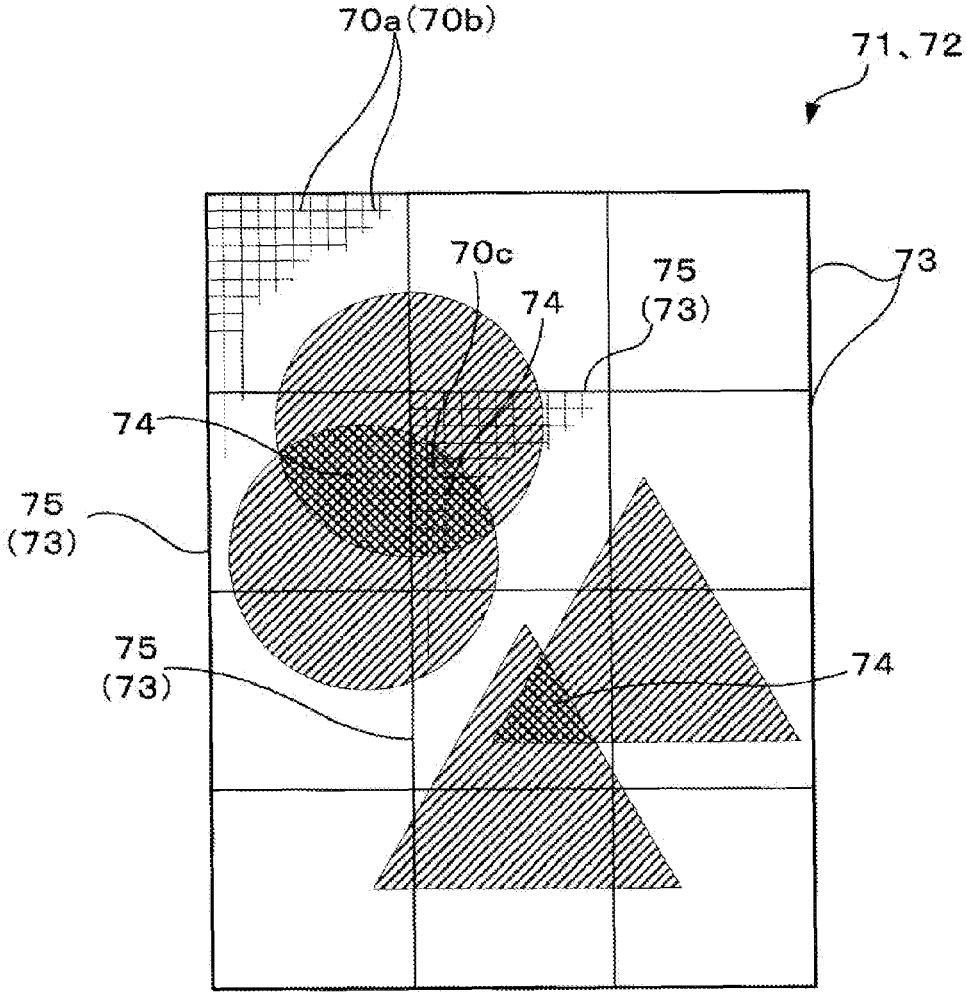
FIG. 5 is an illustration for describing an overlap area extracted by an overlap-area extracting unit illustrated in FIG. 3 according to an illustrative aspect.

The overlap-area extracting unit 67 retrieves an overlap pixel 70*c* on the basis of the front-side image data 71 and back-side image data 72 used in duplex recording on the single sheet P. The overlap pixel 70*c* is a pixel at which each of both a pixel 70*b* in the back-side image data 72 and a pixel 70*a* corresponding to the position opposite to that pixel 70*b* in the front-side image data 71 in the sheet P has a pre-quantization gray level value larger than zero. That is, the overlap pixels 70*c* form an overlap part 74 (see FIG. 5), where images recorded on the front and back sides of the sheet P overlap each other. Alternatively, each of the overlap pixels 70*c* may be a pixel having a gray level value equal to or larger than a predetermined threshold larger than zero. In addition, the overlap-area extracting unit 67 defines 12 block areas 73 that contain neighboring pixels 70*b* and that are arranged in a matrix (for example, 3×4 in the present illustrative embodiment) over the entire back side without overlapping each other, and extracts one or more block areas 73 that contain a predetermined number (for example, a number equal to or larger than 10% of the number of pixels contained in each of the block areas 73) or more of overlap pixels 70*c* from the 12 block areas 73 as one or more overlap areas 75. The predetermined number is used for removing a discrete overlap pixel 70*c* unnecessary to consider in calculating the drying time (described below) and may preferably be a number that does not affect the drying time. The block areas may have any shape when they are arranged over the entire recording area of the back side, have the same size, and do not overlap each other, and the number of them is more than one.

The drying process setting determining unit 68 determines the setting of a drying process required to dry the sheet P on which images have been recorded, that is, ink droplets have been ejected, on the basis of droplet data and the ink penetration rate for the sheet P. In the present illustrative embodiment, a drying method used in the drying process is naturally drying the sheet P at the guide 34 in the conveying device 3, and the drying time being the time required for the naturally drying is determined. The drying process setting determining unit 68 includes a drying-time determining unit 68*a* configured to calculate and determine the drying time and a correcting unit 68*b*. The process of calculating the drying time in the drying-time determining unit 68*a* in simplex recording is different from that in duplex recording.

In duplex recording, the drying-time determining unit 68*a* calculates an area drying time required to dry ejected ink droplets from the total volume of ink droplets to be ejected to the front and back sides of the sheet P obtained from droplet data and the ink penetration rate for that sheet P stored in the sheet information storage portion 62*c* for each of the overlap areas 75 extracted by the overlap-area extracting unit 67. At this time, the correcting unit 68*b* corrects the volume of ink droplets to be ejected to the front side such that it decreases with an increase in the amount of time elapsed from when ink droplets reach that front side to when ink droplets reach the back side. This elapsed time can be estimated from the conveying speed of the sheet P relating to the recording instruction. The relationship between the conveying speed and the elapsed time may be stored in a table. Alternatively, a uniform correction may be made independently of the conveying speed. Here, the length of the area drying time in the overlap area 75 increases with an increase in the total volume of ink droplets to be ejected to the back side and increases with an increase in the total volume of ink droplets to be ejected to the front side. The length of the area drying time in the overlap area 75 increases with a reduction in the ink penetration rate.

The drying-time determining unit 68*a* calculates the area drying time for each of the block areas 73 other than the overlap area 75 from the volume of ink droplets to be ejected to the back side of the sheet P obtained from droplet data created by quantization and the ink absorption rate for that sheet P. Here, the reason why ejection of ink to the front side in each of the block areas 73 other than the overlap area 75 is ignorable is that the amount of ink ejected to the front side in the other areas is smaller than that in the overlap area 75, and the effect of the ink ejection on the back side is considered small. The drying-time determining unit 68*a* determines that the maximum area drying time out of all of the calculated area drying times is the drying time. Here, the length of the area drying time in the block area 73 other than the overlap area 75 increases with an increase in the total volume of ink droplets to be ejected to the back side and increases with a reduction in the ink absorption rate. In contrast, in simplex recording, the drying-time determining unit 68*a* calculates the area drying time for each block area 73 from the volume of ink droplets to be ejected to the sheet P and the ink absorption rate for that sheet P, and determines that the maximum drying time out of all of the calculated area drying times is the drying time. The drying time may not be calculated each time. For example, the relationship between the volume of ejected ink and the drying time may be stored in a table. Here, the length of the area drying time in the block area 73 in simplex recording increases with an increase in the total volume of ink droplets to be ejected to the back side and increases with a reduction in the ink absorption rate.

The head control unit 66 controls an operation of ejecting ink droplets by the head 2. The convey control unit 69 controls conveying of the sheet P by the conveying device 3. The instruction executing unit 63 drives the head 2 and conveying device 3 through the head control unit 66 and convey control unit 69 to enable execution of a recording instruction sent from the PC 60.

When receiving a recording instruction to perform simplex recording from the PC 60, for example, the instruction executing unit 63 controls the head 2 and conveying device 3 on the basis of the recording instruction. Specifically, the convey control unit 69 having received the instruction from the instruction executing unit 63 drives the paper feed device 23 and pairs of conveying rollers 41 to 45 included in the conveying device 3. The sheet P fed from the paper feed tray 24 is guided by the upstream guide device 3*a* and sent to the recording zone (between the platen 3*d* and head 2). The head control unit 66 having received the instruction from the instruction executing unit 63 causes the head 2 to eject ink droplets to the sheet P passing directly below the head 2. In this way, a desired image is recorded on the front side of the sheet P. The operation of ejecting ink (ink ejection timing) is based on a detection signal from a paper sensor 26. The paper sensor 26 is disposed upstream of the head 2 in the conveying direction, and detects the leading end of the sheet P. The sheet P with the image being recorded thereon is guided by the downstream guide device 3*b* and conveyed to the discharge tray 30. A drying control unit 76 having received the instruction from the instruction executing unit 63 dries the sheet P with the image being recorded thereon at the guide 34 for the drying time determined by the drying-time determining unit 68*a* in the drying process setting determining unit 68. After that, the drying control unit 76 drives the pair of conveying rollers 45 in the conveying device 3 such that the sheet P is discharged from the upper part of the casing 1*a* to the discharge tray 30. Because it is merely necessary that the drying control unit 76 does not discharge the sheet P with the image being recorded thereon to the discharge tray 30 until the drying time has elapsed, a method of drying the sheet P may be drying while the sheet P is made to wait at the guide 34, drying while the sheet P is conveyed at the guide 34 with a reduced conveying speed, or a combination thereof.

When receiving a recording instruction to perform duplex recording from the PC 60, for example, the instruction executing unit 63 controls the head 2 and conveying device 3 on the basis of the recording instruction. Specifically, the conveying control unit 69 having received the instruction from the instruction executing unit 63 drives the paper feed device 23 and pairs of conveying rollers 41 to 45. First, as in the case of simplex recording, an image is formed on the front side of the sheet P, and the sheet P is conveyed toward the discharge tray 30. As illustrated in FIG. 1, the sheet sensor 27 is disposed in the vicinity of the upstream side of the pair of conveying rollers 44 in the downstream guide device 3*b*, where the sheet P is being conveyed. When the sheet sensor 27 detects the rear end of the sheet P, the pair of conveying rollers 44 is reversely rotated, and the direction of conveying the sheet P is reversed. At this time, the pairs of conveying rollers 46 to 48 and the pair of oblique conveying rollers 53 are also driven. This switches the path of the sheet P, and the sheet P is conveyed along the paper reconveying path (path indicated by the hollow arrows). As a result, the sheet P subjected to positioning in the main-scanning direction can be retransmitted to the recording zone. The sheet P retransmitted along the paper reconveying path to the upstream guide device 3*a* is resupplied to the recording zone in the state where the front side faces downward, and an image is recorded on the back side. Before the image is recorded on the back side, when the leading end of the sheet P is detected by the sheet sensor 26, the pair of conveying rollers 44 is returned to forward rotation. The sheet P with the images being recorded on its both sides is discharged through the downstream guide device 3*b* to the discharge tray 30.

Figure 6:
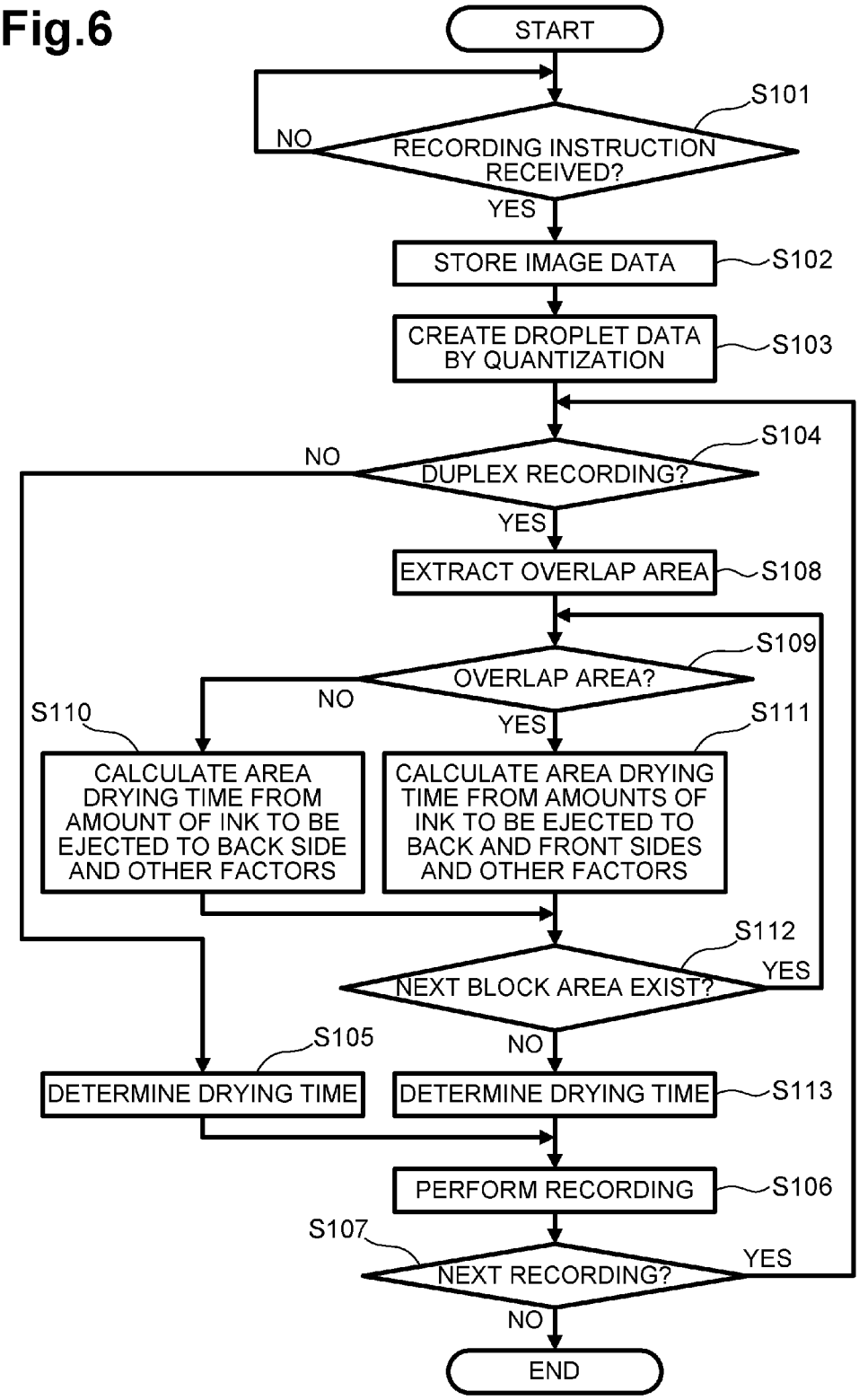
FIG. 6 is a flowchart that illustrates a recording operation of the printer illustrated in FIG. 1 according to an illustrative aspect.

Next, a typical recording operation is described with reference to FIG. 6. As illustrated in FIG. 6, the operation waits until a recording instruction sent from the PC 60 is received (No in S101). When the recording instruction sent from the PC 60 is received by the communication device 61 (YES in S101), the instruction executing unit 63 analyzes the recording instruction. When the recording instruction indicates simplex recording, the image data contained in the recording instruction is stored in the front-side image data storage portion 62*a*; when the recording instruction indicates duplex recording, the front-side image data 71 contained in the recording instruction is stored in the front-side image data storage portion 62*a*, and the back-side image data 72 is stored in the back-side image data storage portion 62*b* (S102). The sheet information contained in the recording instruction is stored in the sheet information storage portion 62*c*.

The quantizing unit 65 quantizes the front-side image data 71 and back-side image data 72 stored in the storage device 62 from a value in 256 gray levels from a value in 4 gray levels, and creates droplet data (S103). The drying process setting determining unit 68 determines whether the next recording is duplex recording (S104).

When it is determined that the next recording is not duplex recording but simplex recording (NO in S104), the drying-time determining unit 68*a* calculates the volume of ink droplets to be ejected to the front side of the sheet P in each of the block areas 73 on the basis of the droplet data created by quantization of the front-side image data 71 stored in the storage device 62 to the value in 4 gray levels, calculates the area drying time from the calculated volume and the ink absorption rate for that sheet P, and determines that the maximum drying time out of all of the calculated area drying times is the drying time for the sheet P (S105).

The head control unit 66 and conveying control unit 69 control the head 2 and conveying device 3 so as to perform front-side recording such that the image relating to the front-side image data 71 stored in the front-side image data storage portion 62*a* is recorded on the front side of the sheet P on the basis of the droplet data created by quantization and the drying time determined by the drying process setting determining unit 68, cause the sheet P to wait at the guide 34 in a stationary state until the drying time has elapsed from the recording, and discharge the dried sheet P to the discharge tray 30 (S106).

The instruction executing unit 63 determines whether there is next recording (S107). When it is determined that there is next recording (YES in S107), the drying process setting determining unit 68 determines whether the next recording is duplex recording (S104). When there is no next recording (NO in S107), the process of the flowchart in FIG. 6 ends.

When it is determined that the next recording is duplex recording (YES in S104), the overlap-area extracting unit 67 retrieves the overlap pixels 70*c* from the pixels 70*b* in the back-side image data 72 on the basis of the front-side image data 71 and back-side image data 72 for use in duplex recording on the signal sheet P, and extracts one or more block areas 73 that contain a predetermined number or more of the overlap pixels 70*c* as one or more overlap areas 75 from the 12 block areas 73 (S108).

The drying-time determining unit 68*a* determines whether each of the block areas 73 is the overlap area 75 (S109). When it is determined that the block area 73 is not the overlap area 75 (NO in S109), the drying-time determining unit 68*a* calculates the volume of ink droplets to be ejected to the back side of the sheet P in the block area 73 on the basis of the droplet data created by quantization of the back-side image data 72 stored in the storage device 62 to the value of 4 gray levels, and in addition, calculates the area drying time from the calculated volume and the ink absorption rate for the sheet P stored in the sheet information storage portion 62*c* (S110). When it is determined that the block area 73 is the overlap area 75 (YES in S109), the drying-time determining unit 68*a* calculates the total volume of ink droplets to be ejected to the front and back sides of the sheet P in the block area 73 on the basis of the droplet data created by quantization of the front-side image data 71 and back-side image data 72 stored in the storage device 62, and in addition, calculates the area drying time from the calculated volume and the ink absorption rate for the sheet P (S111). At this time, the correcting unit 68*b* corrects the volume of ink droplets to be ejected to the front side such that it decreases with an increase in the amount of time elapsed from when ink droplets reach the front side to when ink droplets reach the back side. The reason why it is necessary to consider the amount of ink on both sides in calculating the drying time in duplex recording, as described above, is that the ink attached to the front side has an influence on the absorption of ink into the back side. The reason why the ink of the front side has an influence on the ink absorption into the back side is described below. The ink attached to the front side penetrates into the sheet P. The time required to fully dry the penetrating ink is significantly longer than the time required to dry the ink on the surface of the sheet P. Thus, in recording on the back side in duplex recording, it is likely that the ink penetrating after being attached to the front side has not yet been dried. The ink attached to the back side in recording on the back side overlaps the undried ink penetrating from the front side inside the sheet P, and does not easily penetrate. Thus, ink that cannot penetrate out of the ink ejected to the back side of the sheet P remains on the back side. As a result, the time required to dry the ink on the back side is longer than that when no ink is attached to the front side. The drying-time determining unit 68*a* determines whether the next block area 73 exists (S112). When it is determined that the next block area 73 exists (YES in S112), the drying-time determining unit 68*a* determines whether that block area 73 is the overlap area 75 (S109). When it is determined that the next block area 73 does not exist (NO in S112), the drying-time determining unit 68*a* determines that the maximum drying time out of all of the calculated area drying times is the drying time for the back side (S113).

The head control unit 66, conveying control unit 69, and drying control unit 76 control the head 2 and conveying device 3 so as to perform front-side recording such that the image relating to the front-side image data 71 stored in the front-side image data storage portion 62*a* is recorded on the front side of the sheet P on the basis of the droplet data created by quantization, control the head 2 and conveying device 3 so as to perform back-side recording such that the image relating to the back-side image data 72 stored in the back-side image data storage portion 62*b* is recorded on the back side of the sheet P on the basis of the droplet data created by quantization and the drying time determined by the drying process setting determining unit 68, cause the sheet P to wait at the guide 34 in a stationary state until the drying time has elapsed from the recording, and then discharge the dried sheet P to the discharge tray 30 (S106). The instruction executing unit 63 determines whether there is next recording (S107). When it is determined that there is next recording (YES in S107), the drying process setting determining unit 68 determines whether the next recording is duplex recording (S104). When it is determined that there is no next recording (NO in S107), the process of the flowchart in FIG. 6 ends.

As described above, according to the present illustrative embodiment, in duplex recording, because both the volume of ink droplets to be ejected to the back side and that to the front side are considered in the overlap area 75 extracted from the back-side image data 72, the drying time can be accurately grasped.

At this time, because the volume of ink droplets to be ejected to the front side is corrected such that it decreases with an increase in the amount of time elapsed from when ink droplets reach the front side to when ink droplets reach the back side, the drying time can be more accurately grasped.

In addition, because the overlap-area extracting unit 67 defines the 12 block areas 73 arranged in a matrix over the entire recording area of the back side without overlapping each other, and extracts a block area 73 that contains a predetermined number or more of overlap pixels 70*c* from the 12 block areas 73 as the overlap area 75, the process of extracting the overlap area 75 is facilitated.

Moreover, because the ink absorption rate for the sheet P stored in the sheet information storage portion 62*c* is used in calculating the drying time, the drying time can be more accurately calculated.

Because error diffusion causes part of a gray level value of a single pixel to be developed so as to be diffused to a plurality of pixels, the incidence of overlap pixels 70*c* may decrease. Accordingly, retrieving the overlap pixels 70*c* on the basis of image data before quantization (error diffusion) enables the overlap area 75 to be more accurately extracted.

Because the discharge tray 30 for use in discharging the sheet P dried in the conveying device 3 is included, and the sheet P remains in the conveying device 3 (including the case where it remains while being conveyed) until the sheet P has been dried, the occurrence where the discharge tray 30 or another sheet P previously placed on the discharge tray 30 becomes dirty with undried black ink on the sheet P when the printed sheets are discharged can be reduced.

<First Illustrative Variation>

Figure 7:
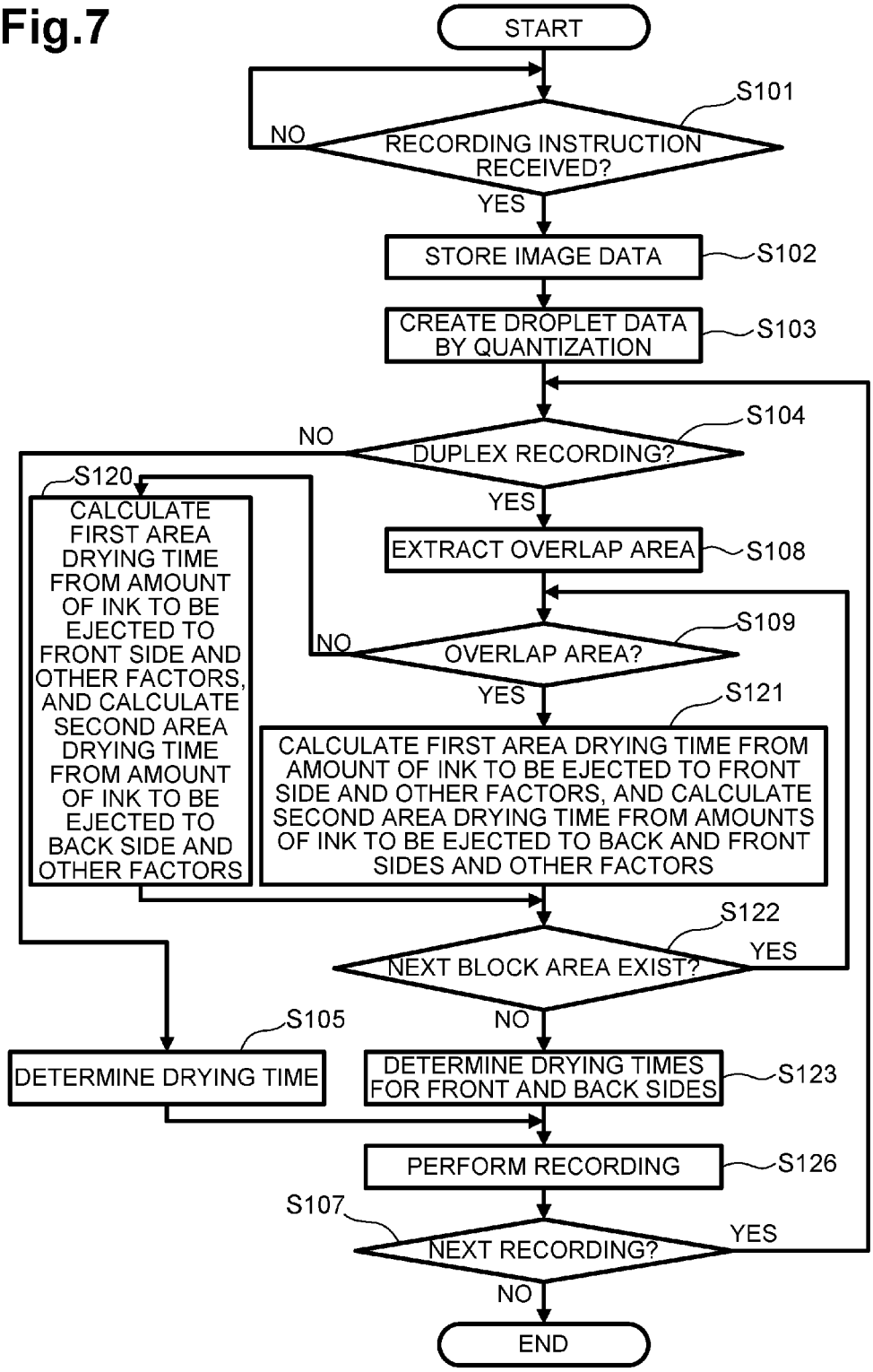
FIG. 7 is a flowchart that illustrates a recording operation of the printer according to a first illustrative variation.

A variation of the present illustrative embodiment is described with reference to FIG. 7. The present variation differs from the above-described illustrative embodiment only in that in duplex recording the front side may be dried after an image is recorded on the front side and before an image is recorded on the back side. Only the process relating to this difference is described below. The drying-time determining unit 68*a* determines whether each of the block areas 73 is the overlap area 75 (S109). When it is determined that the block area 73 is not the overlap area 75 (NO in S109), the drying-time determining unit 68*a* calculates the volume of ink droplets to be ejected to the front side of the sheet P in the block area 73 on the basis of droplet data created by quantization, and in addition, calculates a first area drying time from the calculated volume and the ink absorption rate for the sheet P stored in the sheet information storage portion 62*c*. The drying-time determining unit 68*a* calculates the volume of ink droplets to be ejected to the back side of the sheet P in the block area 73, and in addition, calculates a second area drying time from the calculated volume and the ink absorption rate for the sheet P stored in the sheet information storage portion 62*c* (S120). When it is determined that the block area 73 is the overlap area 75 (YES in S109), the drying-time determining unit 68*a* calculates the volume of ink droplets to be ejected to the front side of the sheet P in the block area 73 on the basis of droplet data created by quantization, and in addition, calculates the first area drying time from the calculated volume and the ink absorption rate for the sheet P stored in the sheet information storage portion 62*c*. The drying-time determining unit 68*a* calculates the total volume of ink droplets to be ejected to the front and back sides of the sheet P in the block area 73, and in addition, calculates the second area drying time from the calculated volume and the ink absorption rate for the sheet P (S121). The drying-time determining unit 68*a* determines whether the next block area 73 exists (S122). When it is determined that the next block area 73 exists (YES in S122), the drying-time determining unit 68*a* determines whether the block area 73 is the overlap area 75 (S109). When it is determined that the next block area 73 does not exist (NO in S122), the drying-time determining unit 68*a* determines that the maximum drying time out of all of the calculated first area drying times is the drying time for the front side, and determines that the maximum area drying time out of all of the calculated second area drying times is the drying time for the back side (S123).

The head control unit 66 and conveying control unit 69 control the head 2 and conveying device 3 so as to perform front-side recording such that the image relating to the front-side image data 71 stored in the front-side image data storage portion 62*a* is recorded on the front side of the sheet P on the basis of the droplet data created by quantization, and cause the sheet P to wait at the guide 34 in a stationary state until the drying time for the front side has elapsed from the recording. After that, the head control unit 66 and conveying control unit 69 control the head 2 and conveying device 3 so as to perform back-side recording such that the image relating to the back-side image data 72 stored in the back-side image data storage portion 62*b* is recorded on the back side of the sheet P on the basis of the droplet data created by quantization and the drying time determined by the drying process setting determining unit 68, cause the sheet P to wait at the guide 34 in a stationary state until the drying time for the back side has elapsed from the recording, and then discharge the dried sheet P to the discharge tray 30 (S126). The instruction executing unit 63 determines whether there is next recording (S107). When it is determined that there is next recording (YES in S107), the drying process setting determining unit 68 determines whether the next recording is duplex recording (S104). When it is determined that there is no next recording (NO in S107), the process of the flowchart in FIG. 6 ends.

In the first illustrative variation, in recording on both sides of the sheet P, after black ink ejected to the front side of the sheet P is dried at the guide 34, the sheet P is conveyed along the paper reconveying path. Accordingly, the occurrence where the paper reconveying path and other components become dirty with the black ink remaining on the front side can be reduced. This process is effective when a large amount of black ink is ejected to the front side of the sheet P.

<Second Illustrative Variation>

Figure 8:
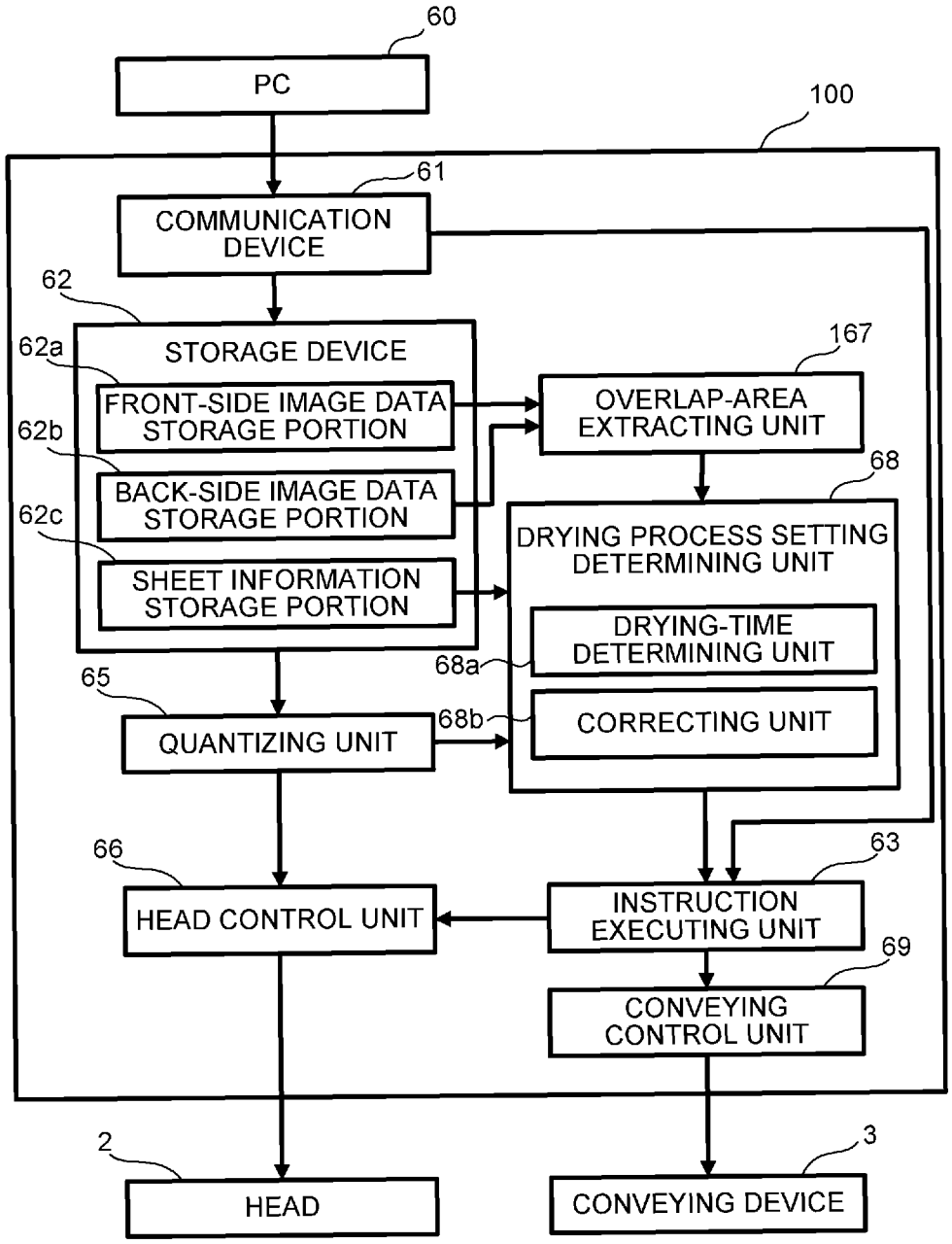
FIG. 8 is a functional block diagram of the control device according to a second illustrative variation.

Another variation of the present illustrative embodiment is described with reference to FIG. 8. The present variation differs only in that it includes an overlap-area extracting unit 167. Only the overlap-area extracting unit 167 is described below. The overlap-area extracting unit 167 extracts one or more block areas 73 that contain a predetermined number or more of overlap pixels 70*c* from the 12 block areas 73. The overlap-area extracting unit 167 extracts, as the overlap area 75, only a block area 73 in which the total volume of ink droplets to be ejected to front and back sides of the sheet P obtained from droplet data is at or above a threshold. At this time, the threshold decreases with an increase in the ink absorption rate for that sheet P. The reason why a block area 73 in which the total volume of ink droplets is less than the threshold is not extracted from the block areas 73 containing the predetermined number or more of overlap pixels 70*c* is described below. When the total volume of ink droplets to be ejected to the front and back sides is small, it is likely that ink penetrating from the surfaces of both sides into the sheet P do not overlap each other inside the sheet P. Thus, the ink ejected to the back side can sufficiently penetrate into the sheet P. As a result, the drying time of ink attached to the back side is substantially the same as that when no ink is attached to the front side.

<Third Illustrative Variation>

Figure 9:
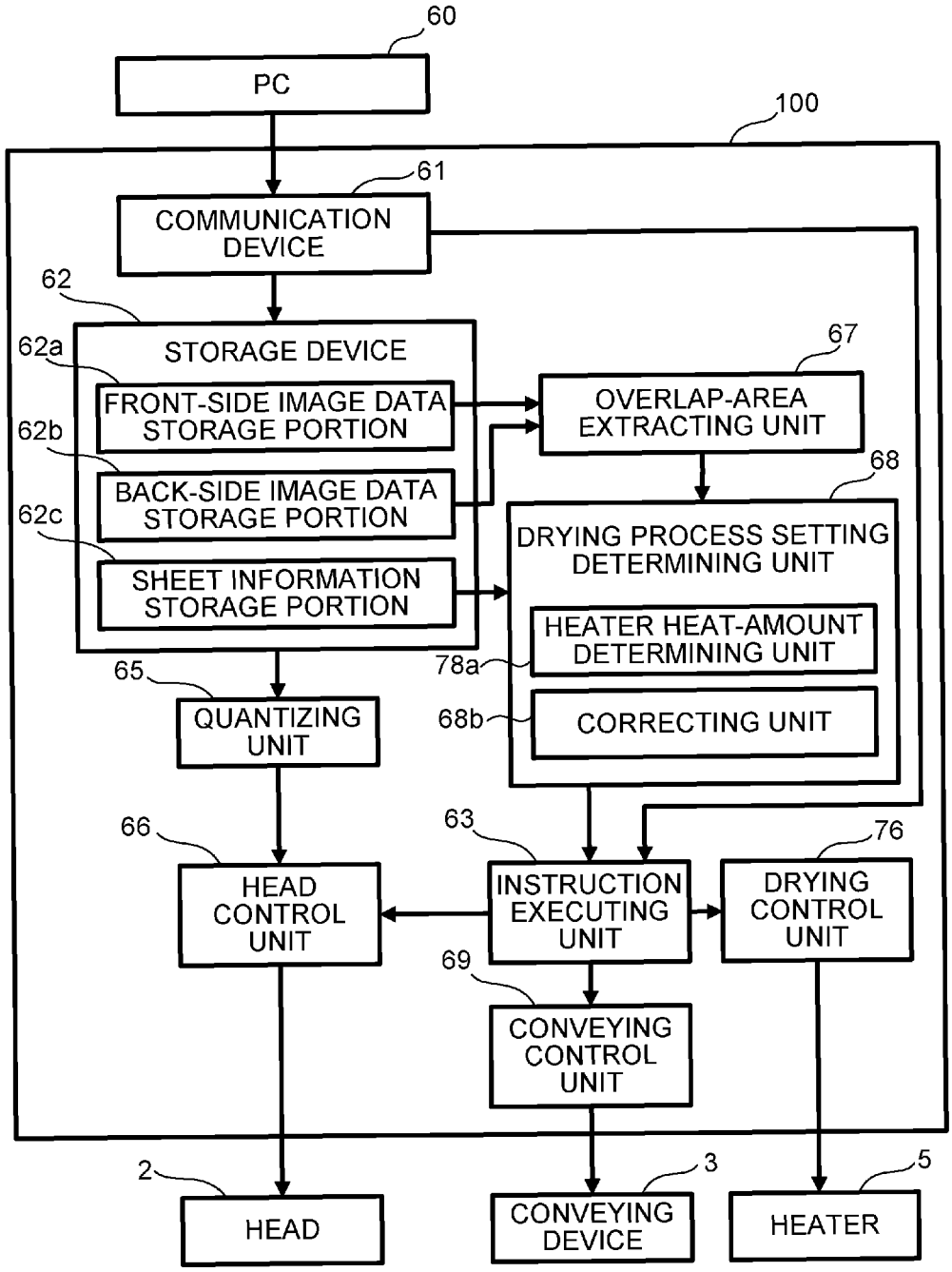
FIG. 9 is a functional block diagram of the control device according to a third illustrative variation.
Figure 10:
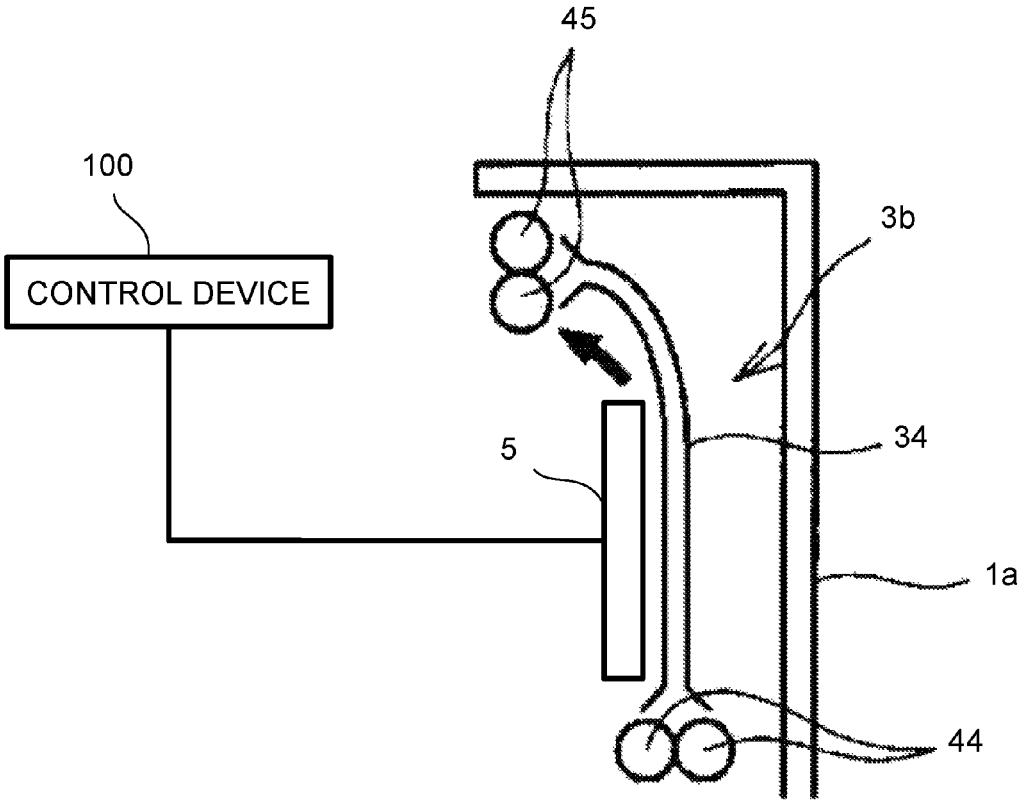
FIG. 10 is an illustration for describing a drying device according to the third illustrative variation.

Another variation of the present illustrative embodiment is described with reference to FIGS. 9 and 10. The present variation differs only in that the drying-time determining unit 68*a* illustrated in FIG. 3 is replaced with a heater heat-amount determining unit 78*a* and in that a drying control unit 76 and a heater 5 (see FIG. 10) as a heating device are added. Only the process relating to these differences is described below. The heater 5 is connected to and controlled by the control device 100. Examples of the heater 5 include a general sheath heater. The heat generated by the heater 5 can force the sheet P passing along the guide 34 or waiting at the guide 34 to be dried. The amount of black ink attached to the sheet P that can be dried in a certain period of time increases with an increase in the amount of heat generated by the heater 5. That is, the drying process in this variation is forcefully drying using the heater. The heater heat-amount determining unit 78*a* determines the amount of heat to be generated by the heater 5 required to dry the sheet P. The amount of heat is determined such that it increases with an increase in the total volume of ink droplets to be ejected to the front or back side of the sheet P.

<Fourth Variation>

Figure 11:
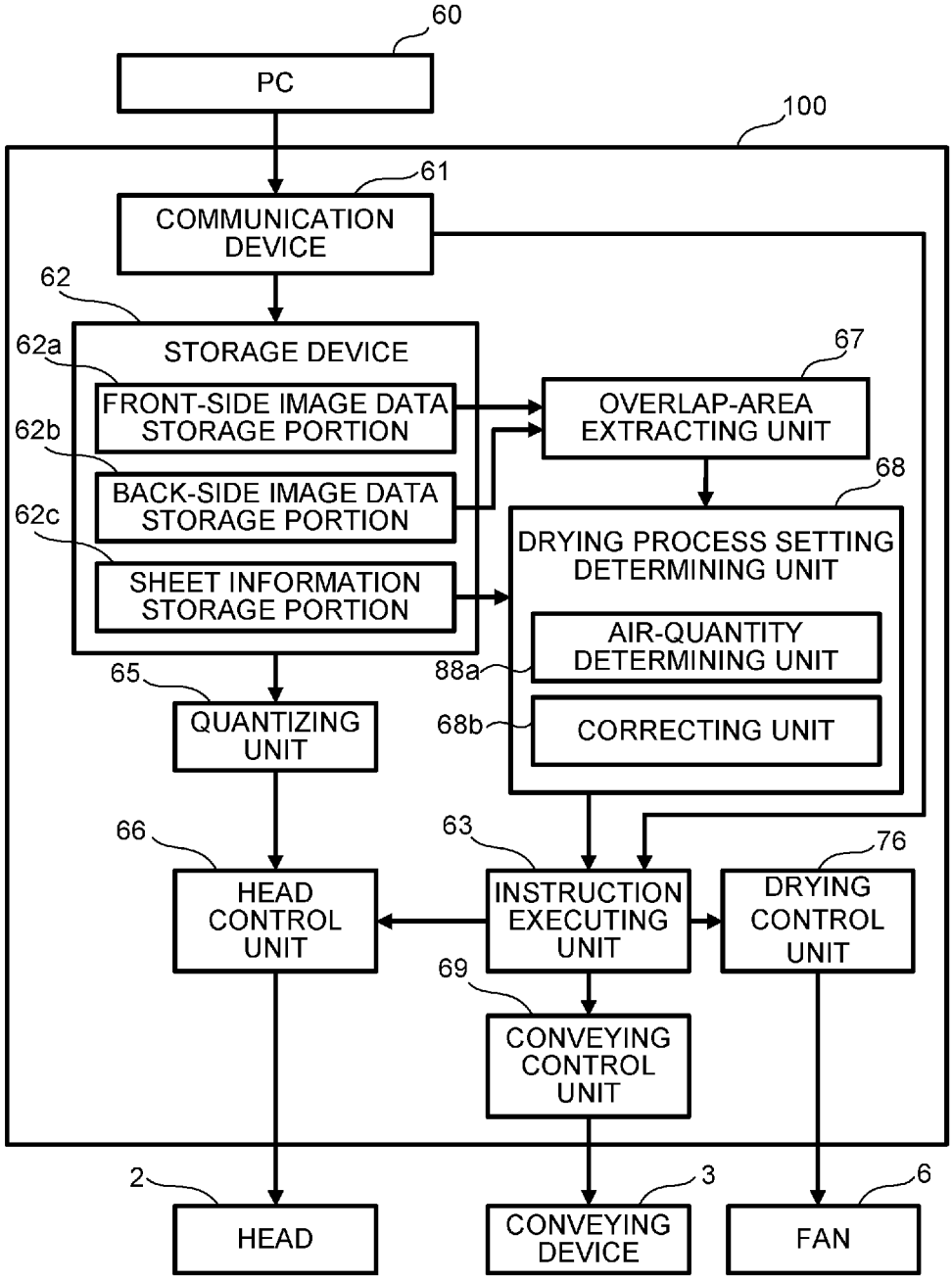
FIG. 11 is a functional block diagram of the control device according to a fourth illustrative variation.
Figure 12:
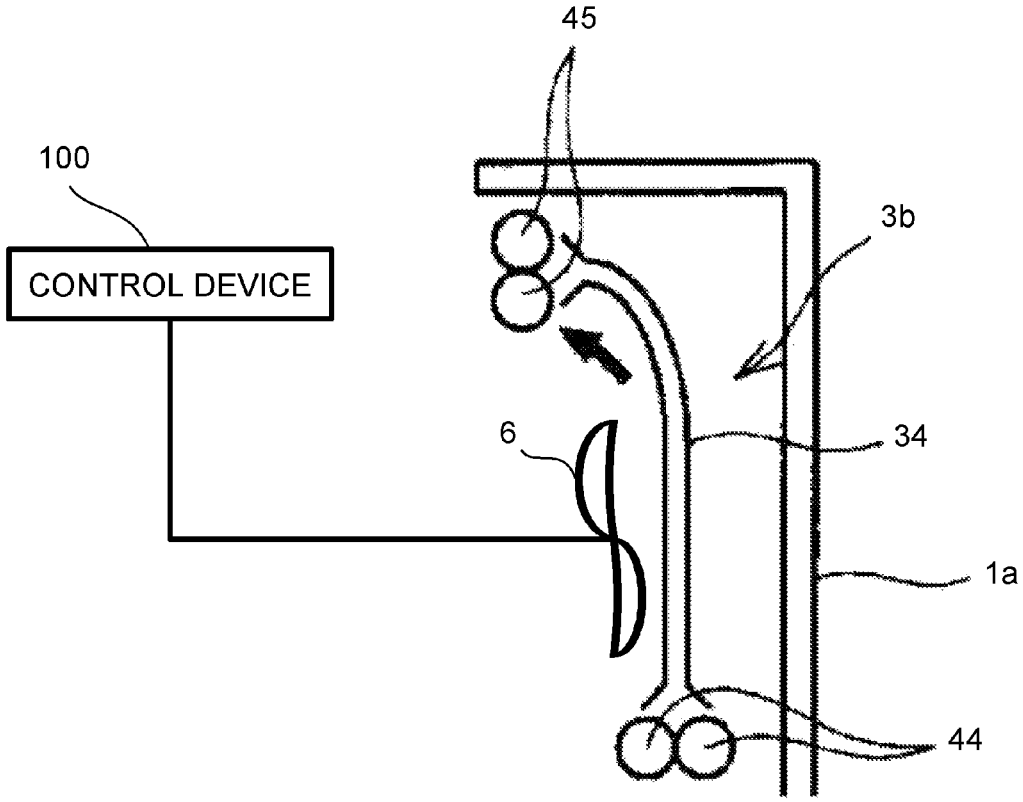
FIG. 12 is an illustration for describing the drying device according to the fourth illustrative variation.

Another variation of the present illustrative embodiment is described with reference to FIGS. 11 and 12. The present variation differs only in that the drying-time determining unit 68*a* illustrated in FIG. 3 is replaced with an air-quantity determining unit 88*a* and in that the drying control unit 76 and a fan 6 (see FIG. 12) as the drying device are added. Only the process relating to these differences is described below. The fan 6 is connected to and controlled by the control device 100. Airflow generated by the fan 6 can force the sheet P passing along the guide 34 or waiting at the guide 34 to be dried. The amount of black ink attached to the sheet P that can be dried in a certain period of time increases with an increase in the strength of the airflow generated by the fan 6. That is, the drying process in this variation is forcefully drying using the fan. The air-quantity determining unit 88*a* determines the quantity of airflow to be generated by the fan 6 required to dry the sheet P, instead of determining the drying time. The quantity of airflow is determined such that it increases with an increase in the total volume of ink droplets ejected to the front or back side of the sheet P.

The preferred illustrative embodiment is described above. The present invention is not limited to the above-described illustrative embodiment. Various changes can be made within the scope of the claims. For example, the correction made in calculating the drying time such that the volume of ink droplets to be ejected to the front side decreases with an increase in the amount of time elapsed from when ink droplets reach that front side to when ink droplets reach the back side in the above-described illustrative embodiment is optional.

In the above-described illustrative embodiment, the block area 73 that contains a predetermined number or more of overlap pixels 70*c* is extracted as the overlap area 75. However, the block area 73 may not be defined in this way. For example, an area where the overlap pixels 70*c* are continuous like islands may be extracted as the overlap area.

In addition, the use of the ink absorption rate for the sheet P in calculating the drying time in the above-described illustrative embodiment is optional.

In the present illustrative embodiment, the overlap area 75 is extracted from image data. Alternatively, the overlap area 75 may be extracted from droplet data after the image data is quantized.

In the present illustrative embodiment, the drying time for the overlap area 75 in the sheet P is calculated from the total volume of ink droplets to be ejected to the front and back sides. Alternatively, the drying time for the overlap area 75 may be calculated from the volume of ink droplets obtained by dividing the total volume of ink droplets to be ejected to the front and back sides by the number of overlap pixels. In this case, the drying time can be more accurately calculated.

In the above-described illustrative embodiment, the drying time is calculated from the total volume of ink droplets to be ejected to the front and back sides of the sheet P. That is, the drying time is calculated using droplet data. Alternatively, the drying time may be calculated using image data. In this case, S110 and S111 in the recording operation illustrated in FIG. 6 are changed to the following. In S110, the drying-time determining unit 68*a* calculates the total of the gray level values in the block area 73 on the basis of the back-side image data 72, and in addition, calculates the area drying time from the total of the calculated gray level values and the ink absorption rate for the sheet P stored in the sheet information storage portion 62*c*. In S111, the drying-time determining unit 68*a* calculates the total of the gray level values in the block area 73 on the basis of the front-side image data 71 and back-side image data 72, and in addition, calculates the area drying time from the total of the calculated gray level values and the ink absorption rate for the sheet P.

In the above-described illustrative embodiment, all the storage device 62, overlap-area extracting unit 67, and drying process setting determining unit 68 are included in the control device 100. Alternatively, at least a portion of the functional units may be included in an external apparatus, such as a PC.

In the above-described illustrative embodiment, the control device 100 includes a single CPU. Alternatively, the control device 100 may include a plurality of CPUs, an application specific integrated circuit (ASIC), or a combination of a CPU and an ASIC.

Aspects of the disclosure are applicable to any conveying device that can convey a medium. Aspects of the disclosure are applicable to each of the line type and serial type, and also applicable to not only a printer but also a facsimile machine, a copier, and other apparatuses. In addition, aspects of the disclosure are applicable to any recording apparatus that records an image. A recording medium is not limited to the sheet P, and can be of various kinds of recording media.

What is claimed is:

1. A droplet ejecting apparatus comprising:

a droplet ejecting head configured to eject liquid for recording an image on a recording medium;

a conveying mechanism configured to convey the recording medium such that a first surface of the recording medium faces the droplet ejecting head and then configured to convey the recording medium such that a second surface of the recording medium opposite to the first surface, faces the droplet ejecting head;

a storage device configured to store first image data relating to an image to be recorded on the first surface of the recording medium and second image data relating to an image to be recorded on the second surface of the recording medium, each of the first image data and the second image data being image data including a plurality of pixels arranged in a matrix, each of the plurality of pixels having a gray level value;

a processor;

memory configured to store executable instructions that, when executed by the processor, cause the droplet ejecting apparatus to perform operations including:

extracting one or more overlap areas from areas contained in the first image data and the second image data, each of the one or more overlap areas containing at least a predetermined number of overlapping pixels, each of the overlapping pixels being either a pixel for the first surface that has a gray level greater than zero or a pixel for the second surface that has a gray level value greater than zero, and a drying process setting determining process including determining a drying process setting to dry liquid ejected from the droplet ejecting head onto the second surface for each of the one or more overlap areas extracted based on a total volume of the liquid to be ejected to the first surface and the second surface or based on a total of the gray level values of the first image data and the gray level values of the second image data, determining a drying process setting for the areas other than the one or more overlap areas based on the volume of liquid to be ejected to the second surface or based on the gray level values of the second image data, determining a maximum setting of the drying process out of the determined settings of the drying process is a setting of the drying process to dry the second surface of the recording medium, changing the volume of the liquid to be ejected to the first surface in the overlap areas or the total of the gray level values of the first image data in the overlap areas with an amount of time elapsed from when droplets reach the first surface in the overlap areas to when droplets reach the second surface in the overlap areas, and for the overlap areas, determining the drying process setting determined from the volume of the liquid to be ejected to the first surface that was changed and the volume of the liquid to be ejected to the second surface or a total of the gray level values of the first image data that was changed and the gray level values of the second image data.

2. The droplet ejecting apparatus according to claim 1, wherein the extracting operation includes setting a plurality of block areas in a recording area where the image for the second surface is recordable, the plurality of block areas corresponding to a plurality of neighboring pixels and being arranged in a matrix over the entire recording area, and extracting a block area corresponding to each of the overlap areas from the plurality of block areas.

3. The droplet ejecting apparatus according to claim 1, wherein the extracting operation includes extracting the overlap area only under a condition in which the total volume of the liquid to be ejected to the second surface and the first surface or the total of the gray level values of the first image data and the gray level values of the second image data is equal to or larger than a threshold.

4. The droplet ejecting apparatus according to claim 3, wherein the storage device is configured to store absorption rate information indicating an absorption rate of the liquid for each of a plurality of types of recording media, and the extracting operation includes decreasing the threshold responsive to an increase in the absorption rate indicated by the absorption rate information for the recording medium on which the images are to be recorded on the first surface and the second surface.

5. The droplet ejecting apparatus according to claim 1, wherein the executable instructions, when executed by the processor, cause the droplet ejecting apparatus to perform operations including:

creating droplet data in which each of the gray level values of the pixels contained in the image data is quantized to one of a plurality of droplet types to be ejected from the droplet ejecting head, wherein the drying process setting is determined using the created droplet data.

6. The droplet ejecting apparatus according to claim 1, wherein the executable instructions, when executed by the processor, cause the droplet ejecting apparatus to perform operations including:

for each of the areas in the first surface of the recording medium, determining a drying process setting to dry liquid to be ejected from the droplet ejecting head onto the first surface based on the total volume of the liquid to be ejected onto the first surface or the total of the gray level values of the first image data, and determining that a maximum setting of the drying process out of all of the determined settings of the drying process is a setting of the drying process to dry the first surface of the recording medium.

7. The droplet ejecting apparatus according to claim 1, further comprising a discharge tray configured to discharge the recording medium, wherein the setting of the drying process is a length of time to dry the recording medium, and wherein the executable instructions, when executed by the processor, cause the droplet ejecting apparatus to further perform operations including controlling the conveying mechanism such that, after the image is recorded on the second surface of the recording medium by the droplet ejecting head, the recording medium with the image recorded on the second surface is not discharged to the discharge tray until the length of time determined in the drying process setting determining process has elapsed.

8. The droplet ejecting apparatus according to claim 1, further comprising:

a heater configured to dry the recording medium conveyed by the conveying mechanism based on the determined setting of the drying process; and a discharge tray configured to discharge the recording medium dried by the heater, wherein the determined setting of the drying process is an amount of heat generated by the heater.

9. The droplet ejecting apparatus according to claim 1, further comprising:

a fan configured to dry the recording medium conveyed by the conveying mechanism by providing the recording medium with airflow based on the determined setting of the drying process; and a discharge tray configured to discharge the recording medium dried by the fan, wherein the determined setting of the drying process is a strength of the airflow generated by the fan.

10. A non-transitory, computer-readable medium storing computer-readable instructions therein that, when executed by a processor of a droplet ejecting apparatus, cause the processor to execute the steps of:

storing first image data relating to an image to be recorded on a first surface of a recording medium and second image data relating to an image to be recorded on a second surface of the recording medium, each of the first image data and the second image data being image data including a plurality of pixels arranged in a matrix, each of the plurality of pixels having a gray level value;

extracting one or more overlap areas from areas contained in the first image data and the second image data, each of the one or more overlap areas containing at least a predetermined number of overlapping pixels, each of the overlapping pixels being either a pixel for the first surface that has a gray level greater than zero or a pixel for the second surface that has a gray level value greater than zero, determining a setting of a drying process to dry liquid ejected from a droplet ejecting head of the droplet ejecting apparatus onto the second surface for each of the one or more overlap areas extracted based on a total volume of liquid to be ejected to the first surface and the second surface or based on a total of the gray level values of the first image data and the gray level values of the second image data, determining a setting of the drying process for the areas other than the one or more overlap areas based on a volume of the liquid to be ejected to the second surface or based on the gray level values of the second image data, determining a maximum setting of the drying process out of the determined settings of the drying process is a setting of the drying process to dry the second surface of the recording medium, changing the volume of the liquid to be ejected to the first surface in the overlap areas or the total of the gray level values of the first image data in the overlap areas with an amount of time elapsed from when droplets reach the first surface in the overlap areas to when droplets reach the second surface in the overlap areas, and for the overlap areas, determining the drying process setting determined from the volume of the liquid to be ejected to the first surface that was changed and the volume of the liquid to be ejected to the second surface or a total of the gray level values of the first image data that was changed and the gray level values of the second image data.

11. A droplet ejecting apparatus comprising:

a droplet ejecting head configured to eject liquid for recording an image on a recording medium;

a conveying mechanism configured to convey the recording medium such that a first surface of the recording medium faces the droplet ejecting head and then configured to convey the recording medium such that a second surface of the recording medium opposite to the first surface, faces the droplet ejecting head;

a storage device configured to store first image data relating to an image to be recorded on the first surface of the recording medium and second image data relating to an image to be recorded on the second surface of the recording medium, each of the first image data and the second image data being image data including a plurality of pixels arranged in a matrix, each of the plurality of pixels having a gray level value;

a control device configured to perform extracting of one or more overlap areas from areas contained in the first image data and the second image data, each of the one or more overlap areas containing at least a predetermined number of overlapping pixels, each of the overlapping pixels being either a pixel for the first surface that has a gray level greater than zero or a pixel for the second surface that has a gray level value greater than zero, perform a drying process setting determining process including determining a drying process setting to dry liquid ejected from the droplet ejecting head onto the second surface for each of the one or more overlap areas extracted based on a total volume of the liquid to be ejected to the first surface and the second surface or based on a total of the gray level values of the first image data and the gray level values of the second image data, determining a drying process setting for the areas other than the one or more overlap areas based on the volume of liquid to be ejected to the second surface or based on the gray level values of the second image data, determining a maximum setting of the drying process out of all of the determined settings of the drying process is a setting of the drying process to dry the second surface of the recording medium, changing the volume of the liquid to be ejected to the first surface in the overlap areas or the total of the gray level values of the first image data in the overlap areas with an amount of time elapsed from when droplets reach the first surface in the overlap areas to when droplets reach the second surface in the overlap areas, and for the overlap areas, determining the drying process setting determined from the volume of the liquid to be ejected to the first surface that was changed and the volume of the liquid to be ejected to the second surface or a total of the gray level values of the first image data that was changed and the gray level values of the second image data.

12. The droplet ejecting apparatus according to claim 11, wherein the extracting includes setting a plurality of block areas in a recording area where the image for the second surface is recordable, the plurality of block areas corresponding to a plurality of neighboring pixels and being arranged in a matrix over the entire recording area, and extracting a block area corresponding to each of the overlap areas from the plurality of block areas.

13. The droplet ejecting apparatus according to claim 11, wherein the extracting includes extracting the overlap area only under a condition in which the total volume of the liquid to be ejected to the second surface and the first surface or the total of the gray level values of the first image data and the gray level values of the second image data is equal to or larger than a threshold.

14. The droplet ejecting apparatus according to claim 13, wherein the storage device is configured to store absorption rate information indicating an absorption rate of the liquid for each of a plurality of types of recording media, and the extracting includes decreasing the threshold responsive to an increase in the absorption rate indicated by the absorption rate information for the recording medium on which the images are to be recorded on the first surface and the second surface.

15. The droplet ejecting apparatus according to claim 11, wherein the control device is further configured to:

create droplet data in which each of the gray level values of the pixels contained in the image data is quantized to one of a plurality of droplet types to be ejected from the droplet ejecting head, wherein the drying process setting is determined using the created droplet data.

16. The droplet ejecting apparatus according to claim 11, wherein the executable instructions, when executed by the processor, cause the droplet ejecting apparatus to perform operations including:

for each of the areas in the first surface of the recording medium, determine a drying process setting to dry liquid to be ejected from the droplet ejecting head onto the first surface based on the total volume of the liquid to be ejected onto the first surface or the total of the gray level values of the first image data, and determine that a maximum setting of the drying process out of all of the determined settings of the drying process is a setting of the drying process to dry the first surface of the recording medium.

17. The droplet ejecting apparatus according to claim 11, further comprising a discharge tray configured to discharge the recording medium, wherein the setting of the drying process is a length of time to dry the recording medium, and wherein the control device is further configured to control the conveying mechanism such that, after the image is recorded on the second surface of the recording medium by the droplet ejecting head, the recording medium with the image recorded on the second surface is not discharged to the discharge tray until the length of time determined in the drying process setting determining process has elapsed.

18. The droplet ejecting apparatus according to claim 11, further comprising:

a heater configured to dry the recording medium conveyed by the conveying mechanism based on the determined setting of the drying process; and a discharge tray configured to discharge the recording medium dried by the heater, wherein the determined setting of the drying process is an amount of heat generated by the heater.

* * * * *